United States Patent [19]

Holman

[11] Patent Number: 4,569,076

[45] Date of Patent: Feb. 4, 1986

[54] MOTION PICTURE THEATER LOUDSPEAKER SYSTEM

[75] Inventor: Tomlinson Holman, Fairfax, Calif.

[73] Assignee: Lucasfilm Ltd., San Rafael, Calif.

[21] Appl. No.: 492,994

[22] Filed: May 9, 1983

[51] Int. Cl.[4] ..... H04R 27/00

[52] U.S. Cl. ..... 381/82; 381/90; 181/151

[58] Field of Search ..... 381/88-90, 381/100, 103, 83, 82; 350/118; 181/199, 146, 155, 151; 179/146 E

[56] References Cited

U.S. PATENT DOCUMENTS

| | | | |
|---|---|---|---|
| 1,817,630 | 8/1931 | Kroesen | 350/118 |
| 2,426,928 | 9/1947 | Gazlay | 181/199 |
| 3,125,181 | 3/1964 | Pawlowski | 381/82 |

OTHER PUBLICATIONS

Small, "Vented-Box Loudspeaker Systems; Part I: Small-Signal Analysis", J. Audio Eng. Soc., vol. 21, No. 5, Jun. 1973, pp. 363-372.

Small, "Vented-Box Loudspeaker Systems; Part II: Large-Signal Analysis", J. Aud. Eng. Soc., vol. 21, No. 6, Jul./Aug. 1973, pp. 439-444.

Small, "Vented-Box Loudspeaker Systems; Part III: Synthesis", J. Aud. Eng. Soc., vol. 21, No. 7, Sep. 1973, pp. 549-554.

Small, "Vented-Box Loudspeaker Systems; Part IV: Appendices", J. Aud. Eng. Soc., vol. 21, No. 8, Oct. 1973, pp. 635-639.

James Lansing Sound Inc., data sheet for "Professional Series—Model 2225H/J, 380 mm (15 in) Low Frequency Transducer, Apr. 1981.

J. Lansing Sound, Inc., data sht. for "Professional Series—Bi-Radial Constant Coverage Horns", May 1980.

Murray et al., "Three Dimensional Diaphragm Suspensions for Compression Drivers", J. Aud. Eng. Soc., vol. 28, No. 10, Oct. 1980, pp. 720-725.

Adv. for JBL 2441 compression driver, R-e/p, vol. 12, No. 2, Apr. 1981.

Lipshitz et al., "A Family of Linear Phase Crossover Networks of High Shape Derived by Time Delay", J. Aud. Eng. Soc., vol. 31, No. 1/2, Jan. 1983, pp. 2-20.

Linkwitz, "Active Crossover Networks for Noncoincident Drivers", J. Aud. Eng. Soc., vol. 24, No. 1, Jan./Feb. 1976, pp. 2-8.

Linkwitz, "Loudspeaker System Design", Wireless World, May 1978, pp. 52-56.

Linkwitz, "Loudspeaker System Design-Part 2", Wireless World, Jun. 1978, pp. 67-72.

Wilson, "The Design and Gain Bandwidth Dependence of a Class of Single Amplifier Second-Order All-Pass RC Active Networks", IEEE Transactions on Circuits and Systems, vol. CAS-24, No. 8, Aug. 1977, pp. 446+.

Burton, "Multiple-Amplifier RC-Active Filter Design with Emphasis of GIC Realizations", paper 3-4 in Modern Active Filter Design, IEEE Press, New York, 1981.

"Crossover Filters-An Integral Part of Overall System Engineering", pub. in KEFTOPICS, vol. 4, No. 2, by KEF Electronics Ltd., Maidstone, England, circa 1980.

Frater, "'In-Phase' Crossover Networks", 16th Intl. Radio and Electronic Eng. Convention Digest, Melbourne, Aug. 1977, pp. 250-252.

(List continued on next page.

*Primary Examiner*—Forester W. Isen

*Attorney, Agent, or Firm*—Majestic, Gallagher, Parsons & Siebert

[57] ABSTRACT

A motion picture loudspeaker system is described in which the loudspeaker elements are integral with an acoustical boundary wall such that the characteristics of the vented box woofers are optimized. In order to overcome high reflection problems as sound from the tweeters is reflected by the motion picture screen and the acoustical boundary wall, frequency dependent acoustical absorptive material is attached to the wall to inhibit high frequency reflections with minimal effect on the bass optimization. The system includes the use of a steep slope crossover netowrk having a crossover frequency such that there is a first order match of the woofer and tweeter dispersion at the crossover.

20 Claims, 8 Drawing Figures

OTHER PUBLICATIONS

Thiele, "Optimum Passive Loudspeaker Dividing Networks", Proc. IREE Aust., vol. 36, Jul. 1975, pp. 220–224.

Engebretson et al., "Cinema Sound Reproduction Systems", SMPTE Journal, Nov. 1982, pp. 1046–1057.

Allison, "The Influence of Room Boundaries on Loudspeaker Power Output", J. Audio Eng. Soc., vol. 22, No. 5, Jun. 1974, pp. 314–320.

Thiele, "Loudspeakers in Vented Boxes: Part I, J. Audio Eng. Soc., vol. 19, No. 5, May 1971, pp. 382–392.

Thiele, "Loudspeakers in Vented Boxes: Part II", J. Audio Eng. Soc., vol. 19, No. 6, Jun. 1971, pp. 471–483.

MOTION PICTURE THEATER LOUDSPEAKER SYSTEM

BACKGROUND OF THE INVENTION

1. Field of the Invention

The present invention is concerned in general with acoustics and sound reproduction. In particular, the invention is directed to overcoming some of the interrelated loudspeaker and acoustical problems encountered in the motion picture theater environment.

2. Description of the Prior Art

Substantial advances in motion picture sound quality have been made in the past decade, however a weak link remaining in the cinema sound reproduction chain is the theater loudspeaker system and its acoustic environment.

Very few theaters are currently equipped with loudspeaker systems that incorporate state-of-the-art technology and, indeed, most employ systems using components that were originally designed in the 1940's. Typically, such systems employ horn radiators both in the low frequency and high frequency range, perhaps augmented with sub-woofers for very low frequencies to overcome low bass response deficiencies. Audible distortion at high sound levels with bass program material is common. The mid-range dispersion of such systems is oriented for theaters with balconies (i.e., the best mid-range dispersion is vertical). Multi-cell high frequency horns attempted to produce an output relatively constant in amplitude over a range of output angles and frequencies, yet are substantially inferior to more recent designs. The crossover design and dispersion characteristics lead to a "camel-back" shaped power response that is evident when $\frac{1}{3}$-octave pink noise measurements are made in theaters using such systems. The problem is discussed and suggestions for improvement are made in "Cinema Sound Reproduction Systems: Technology Advances and System Design Considerations" by Mark Engebretson and John Eargle, *SMPTE Journal,* November, 1982, pp. 1046–1057.

Engebretson and Eargle suggest the use of a combination of loudspeaker components that employ many of the state-of-the-art techniques in loudspeaker design, including the use of direct radiators in vented boxes as woofers and the use of so-called "constant directivity" horns having wide dispersion as tweeters. While such a combination presents a useful improvement over the systems commonly in use, the smoothness of the low frequency and high frequency response in such a system is not optimum nor is its sound localization and stereo imaging.

SUMMARY OF THE INVENTION

In accordance with the teachings of the present invention a motion picture theater loudspeaker system is provided which has a smoother response, more uniform coverage of the audience, noticeably lower distortion and better sound localization and stereo imaging than other loudspeaker systems currently in use.

The invention employs direct radiator cone diaphragm drivers mounted in vented box enclosures as low frequency or woofer loudspeaker elements. Recognition is made of the fact that such loudspeakers were designed for radiation into a 2-pi steradian radiation angle environment and to simulate such an environment the woofers are made integral with an acoustical boundary wall and are raised sufficiently above the stage floor such that the floor does not substantially interfere with the 2-pi environment simulation.

Constant coverage horn tweeters with low distortion compression drivers are used as tweeters. A steeply sloped crossover network is used having a crossover frequency at a frequency at which the woofer and tweeter dispersions are matched as a first order approximation.

The low frequency and high frequency loudspeaker elements are located integral with the acoustical boundary wall in close proximity behind the motion picture screen. In order to overcome the problem that the screen becomes increasingly reflective to high frequency sound energy, thus causing high frequency sound to be trapped between the screen and the wall and resulting in disturbance of the frequency response and high end tone balance along with a degradation of sound localization and stereo imagaing, sound absorbing material is placed on the wall such that re-radiation of high frequency sound energy from the wall is substantially eliminated.

DETAILED DESCRIPTION OF THE INVENTION

Figure 1:
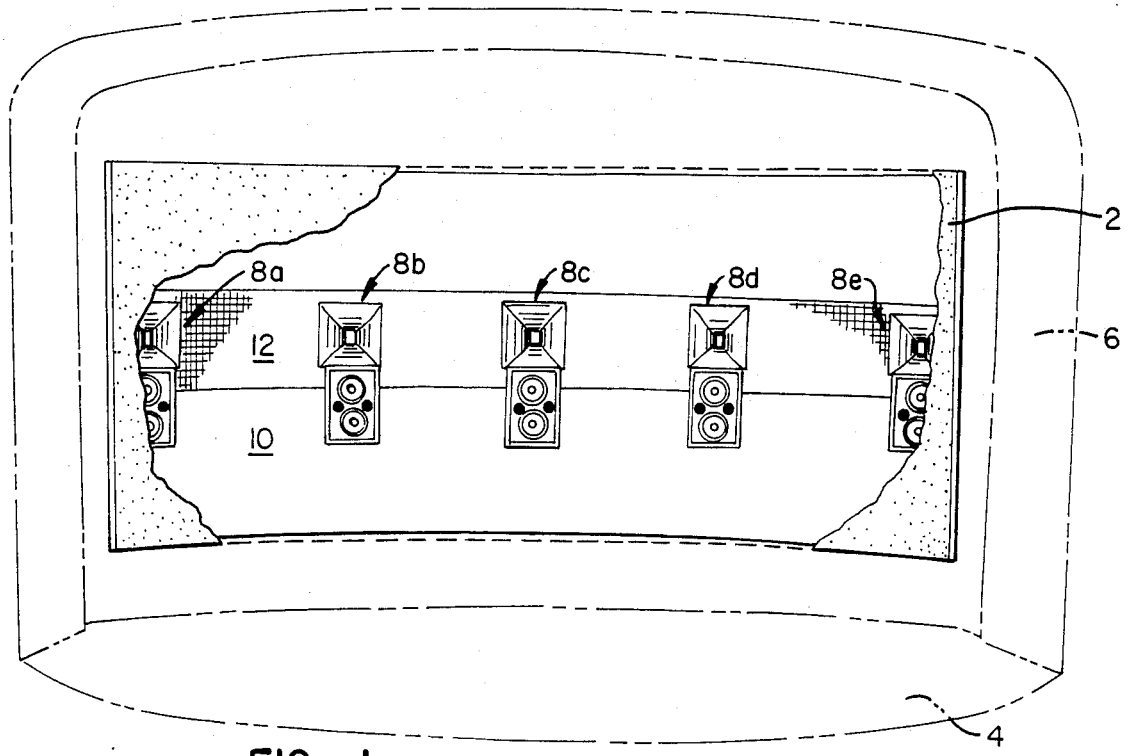
FIG. 1 is an elevation view of the loudspeaker system of the present invention in its motion picture theater environment.

Referring now to the drawings, FIG. 1 shows the loudspeaker system of the present invention in its intended environment in a motion picture theater, behind the motion picture screen with respect to the audience. The audience (not shown) has the perspective of the viewer of FIG. 1. The screen 2 (shown cutaway to reveal the loudspeaker system) is located above the stage 4 and under the proscenium arch 6. In the example of FIG. 1, the loudspeaker system has loudspeaker means that include five sets or combinations of loudspeaker elements 8*a* through 8*e* spaced apart and located well above the stage and substantially in a line behind the screen. A system according to the invention can include one or more sets or combinations of loudspeaker elements. In most theatres three sets of loudspeaker elements would be adequate to provide left, center and right channel sound reproduction when playing multi-channel motion picture films. In very large auditoriums it may be necessary to employ two sets of loudspeaker elements for each channel.

While it is desirable to locate the loudspeaker system behind the screen so that the localization of sound events corresponds with visual events, the presence of the screen significantly affects the sound heard by the audience not only as a result of the screen sound attenuation but also the adverse effects of reflection backward from the screen toward the loudspeaker system and its environment. A typical screen only has about seven or eight percent open area. While the screen is substantially transmissive to low frequency sound (below about 500 Hz), the screen becomes increasingly reflective as the sound rises into the high frequency region. Above about 5 kHz, only about seven percent of the sound is transmitted through the screen, the balance being reflected. The reflected high frequency energy can be re-reflected by surfaces behind the screen. The local environment behind the speakers is in some cases a large open area and in other cases a closely spaced wall. In some theatres there is also a curtain behind the speakers. Such environments can cause high frequency comb frequency effects, alteration of high frequency response and tone balance, lack of sound localization and confused stereo imaging.

A further element of the loudspeaker system of the present invention is the acoustic boundary surface or rigid wall 10 which is integrated with the loudspeaker elements 8*a* through 8*e*. A frequency dependent sound absorptive means 12 is provided adjacent at least a portion of the wall as will be described further below. The wall 10 runs generally parallel to spaced from and at least partially co-extensive with the screen 2. In case of a curved screen, as in FIG. 1, the wall preferably follows the screen curvature.

Each set of combination of loudspeaker elements includes low frequency and high frequency loudspeaker elements. The low frequency or woofer elements include at least one and preferably two direct radiator cone diaphragm loudspeaker transducers mounted in a bass reflex enclosure or box. As discussed further below, a better match of the low frequency speaker dispersion to the high frequency speaker dispersion at the crossover frequency is obtained if two direct radiators are used. In the case of two transducers, they are preferably located vertically adjacent to each other such that the long dimension of the box is vertical to provide the best dispersion horizontally. The box could be mounted on its side for long, thin halls with balconies. The high frequency or tweeter elements include at least one horn with a suitable driver and these elements preferably are located above and adjacent the low frequency loudspeaker elements.

The bass enclosure or box is preferably a vented box. There is a substantial body of literature related to the study of low frequency loudspeakers employing direct radiators and vented boxes, particularly the writings of Thiele, who was one of the first to develop and popularize the electrical circuit analogy of vented box systems, and Small, who built upon and refined Thiele's work. See for example the following articles: "Loudspeakers in Vented Boxes: Part I" by A. N. Thiele, *J. Audio Eng. Soc.*, Vol. 19, No. 5, May, 1971, pp. 382–392; "Loudspeakers in Vented Boxes: Part II" by A. N. Thiele, *J. Audio Eng. Soc.*, Vol. 19, No. 6, June, 1971, pp. 471–483; "Vented-Box Loudspeaker Systems; Part I: Small-Signal Analysis" by Richard H. Small, *J. Audio Eng. Soc.*, Vol 21, No. 5, June, 1973, pp. 363–372 "Vented-Box Loudspeaker Systems; Part II: Large-Signal Analysis" by Richard H. Small, *J. Audio Eng. Soc.*, Vol 21, No. 6, July/August, 1973, pp. 439–444; "Vented-Box Loudspeaker Systems; Part III: Synthesis" by Richard H. Small, *J. Audio Eng. Soc.*, Vol 21, No 7, September, 1973, pp. 549–554; and "Vented-Box Loudspeaker Systems; Part IV; Appendices" by Richard H. Small, *J. Audio Eng. Soc.*, Vol 21, No. 8, October, 1973, pp. 635–639.

Small's studies assumed that the direct radiator vented box loudspeakers radiated into a 2-pi steradian radiation angle environment (true half space). A reasonable simulation of such a condition in a practical environment is to locate the front surface of the loudspeaker flush with an acoustic boundary, such as the acoustic boundary wall 10, such that any intersecting boundaries (such as the stage floor 4) are reasonably far removed. See, for example, "The Influence of Room Boundaries on Loudspeaker Power Output" by Roy F. Allison, *J. Audio Eng. Soc.*, Vol. 22, No. 5, June 1974, pp. 314–320. Allison discusses the mirror-image speaker effect that results when speakers are located in front of walls generate images behind the walls which cause various audible anamolies including mid-range dips. In practice the employment of a flush wall contiguous with the front face of the loudspeaker not only results in a closer match between practice and Small's theory, but prevents mid-bass irregularities and audibly smoothens the overall bass response, thus optimizing the capabilities of the woofer drivers and box. The speaker elements are located at a height approximately mid-way along the screen's vertical dimension in order to maximize the distance from the low frequency elements to the stage floor (to optimize the 2-pi acoustical boundary simulation) while not causing the sound localization to seem high to the listeners in the audience.

While desirable from the standpoint of low frequency sound reproduction, the acoustical boundary wall 10 exacerbates the problem of high frequency screen reflected sound by trapping high frequency energy and thereby causing comb filtering effects and delayed reflections that tend to destroy stereo imaging and to disturb the frequency response and high end tone balance. These problems are particularly acute because the screen-to-wall distance is preferably small (in the order of a few feet) in order to get the sound sources as close to the screen and audience as possible. Thus the high frequency acoustical boundaries created by the wall 10 and the screen 2 has a high Q and is acoustically "hot" at high audio frequencies.

In order to overcome this problem the present invention applies a sound absorptive means 12 to the acoustical boundary wall 10 at least in the vicinity of the high frequency loudspeaker elements. The sound absorptive means 12 is preferably frequency dependent and has acoustic characteristics such that low frequency sound energy is substantially transmitted but that high frequency sound energy is substantially absorbed. Ideally, the acoustic characteristics of the absorptive means are complementary to the high frequency reflection characteristic of the screen such that the absorption increases as the degree of reflection increases with frequency. Suitable materials include wedge-shaped acoustical foam products and mineral wool or glass fiber insulation material of the type used for thermal insulation. One type of acoustical foam wedge material is sold under the trademark Sonex. A mineral wool type insulation material particularly for acoustical insulation is sold under the trademark Thermafiber Sound Attenuation Blanket by U.S. Gypsum. The degree of absorptivity is related to the thickness of the material employed. Any suitable means can be employed to affix the absorptive material to the acoustical boundary wall.

Figure 2:
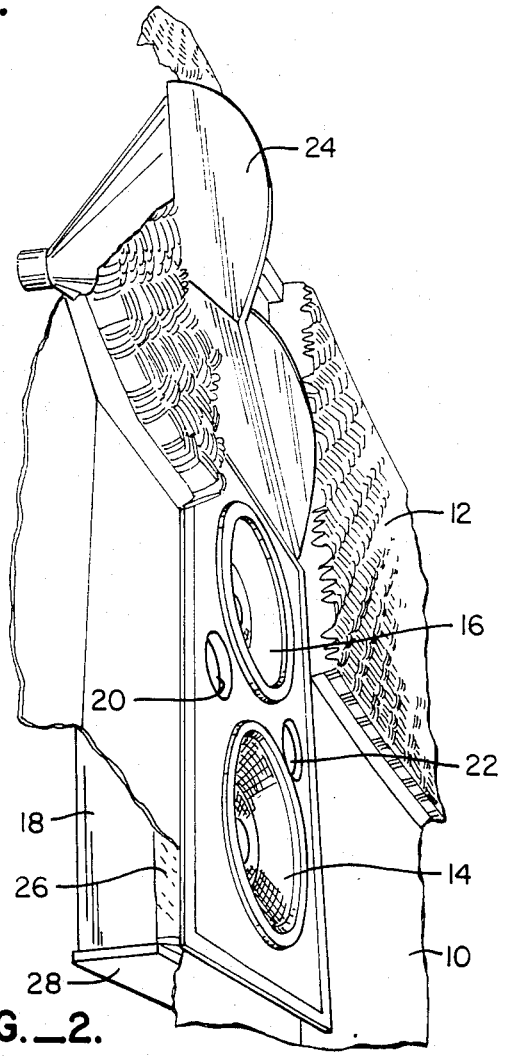
FIG. 2 is a cut-away perspective view showing details of the loudspeaker system of FIG. 1.

A perspective cut-away view of one of the sets of loudspeaker elements is shown in FIG. 2. The low frequency or woofer part of the combination is preferably two direct radiator cone diaphragm loudspeakers 14 and 16 mounted in a vented box 18 which has two circular aperture vents 20 and 22. The high frequency or tweeter elements is preferably a horn 24 and matching compression driver (not shown). A wedge shaped foam acoustic absorption material is shown as the absorptive means 12. The material is shown in the figures affixed to the wall and extending a short distance above and below the extending tweeter horns and along the entire width of the wall 10. The area over which the material 12 is required can be determined geometrically taking into account the tweeter dispersion, the angle of the tweeter with respect to the screen and the distance from the tweeter to the screen.

Although the particular choice of loudspeaker elements is not essential to the invention, the commercial availability of low distortion, efficient and smooth characteristic response components for these elements enhances the overall auditory results of the system. For example, a suitable low frequency transducer, the model JBL 2225H/J, available from the James B. Lansing Co., employs various measures to produce a symmetrical magnetic field that reduces low-frequency distortion, is efficient and is reasonably smooth over the operating range. The same company makes available a suitable vented box, the model JBL 4508, which provides a smoother frequency response and less aberrant polar response than mid-bass horn designs. A suitable high frequency horn and driver are also available from the same company, the JBL 2360 horn and 2441 driver. The horn is of the constant-directivity type that provides good dispersion over a substantial spacial angle. While in the practical embodiment of the invention a 90 by 40 degree angle horn was chosen, this parameter should be chosen for the particular theater such that the audience receives the largest percentage of direct sound possible. Everyone in the audience should be within the −6 dB coverage angle of the horn and, conversely, as little direct sound as practical should be sent to surfaces that would cause long-delayed reflections. The compression driver is of modern design that incorporates structural improvements resulting from laser beam testing on earlier horn driver designs. The same combination of loudspeaker components is suggested in "Cinema Sound Reproduction Systems: Technology Advances and System Design Considerations" by Mark Engebretson and John Eargle, *SMPTE Journal*, November, 1982, pp. 1046–1057.

While the woofer and tweeter are shown integrated with and supported by structural members associated with the acoustical boundary wall, in principle it is only necessary that the vented box woofer enclosure 18 front wall be flush or contiguous with the acoustical boundary wall 10. However, it is preferable from a structural standpoint that the tweeter is also integrated with and supported by structural members associated with the wall 10. In order to allow some freedom in rotatation of the horn and to minimize the depth of the system, the horn is mounted so that its front edges are somewhat forward (in the order of six inches) of the front face of the woofer enclosure. The wall should be rigid and can be constructed of heavy plywood (in the order of ¾" to 1") or, at less expense, several (2 or 3) layers of gypsum construction board (in the order of ½" or ⅝") over a wood frame in either case, for example. Mineral wool or glass fiber type insulation 26 is preferably used on the rear side of the wall to minimize any sound transmission from the wall itself resulting from reverberations in any open space behind the system. The woofer box 18 rests on a support shelf 28 that is integral with the wall support frame. The details of the wall construction and support for the loudspeaker elements are not critical, provided that the structure has sufficient rigidity and adequately supports the loudspeaker elements.

If desired, sub-woofers may be added to the system to provide additional very low frequency response. Also, surround speakers may be additionally employed as desired around the sides and rear of the theater.

Figure 3:
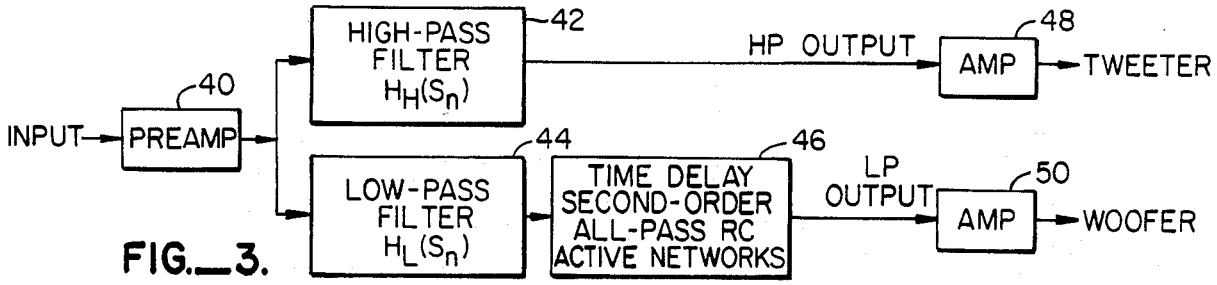
FIG. 3 is a block diagram showing the electrical system, including the crossover networks, for applying audio information carrying electrical energy to the loudspeaker system.

FIG. 3 shows a block diagram of the means for applying audio information carrying electrical energy to the loudspeaker elements, including the crossover network means. Preferably, the crossover networks are located at a low level stage of the system, such as following the preamplifier and before power amplification, rather than at the speaker elements themselves. In this way the crossover networks are not required to handle large amounts of power and they may be adjusted with greater ease and preciseness.

One audio channel, for example, is applied to a preamplifier 40, the output of which is split into two paths, a high-pass path and a low-pass path. The high-pass path includes a high-pass filter 42 with the characteristic $H_H(s_n)$. The low-pass path includes a low-pass filter 44 with the characteristic $H_L(s_n)$ and time delay means 46 that is preferably comprised of cascaded second-order all-pass RC active networks. A time delay is necessary in the low-pass path because in the preferred physical arrangement the woofer element is forward of the tweeter driver element, thus requiring time compensation to assure temporal coherence. Alternatively, the time delay can be located in the high-pass path or omitted in the case of alternative physical arrangements of the speaker system components. In a practical embodiment of the invention, the woofers lie in a shallow box substantially forward of the tweeter horn driver, requiring a 1.9 millisecond delay in the low-pass path.

Bi-amplification is employed such that the high-pass path and low-pass path outputs are applied to separate amplifiers 48 and 50 that drive the respective tweeter and woofer loudspeaker elements.

The high-pass and low-pass filter networks are acoustic 4-th-order Linkwitz-Riley filters as used in some advanced consumer loudspeakers. These networks provide flat amplitude; steep slopes for driver protection; acceptable polar pattern, i.e., minimum lobing by having a short, well-controlled crossover region with attention paid to phase response; and acceptable system phase response. Linkwitz-Riley filters are described in the article: "A Family of Linear-Phase Crossover Networks of High Slope Derived by Time Delay" by Stanley P. Lipshitz and John Vanderkooy, *J. Audio Eng. Soc.*, Vol. 31, No. 1/2, January/February, 1983, pp. 2–20. The low-pass and high-pass sections have matched phase responses with the individual magnitude curves intersecting at −6 dB to provide a combined all-pass response, including the amplitude and phase effects of the loudspeaker drivers themselves. Further details of such networks are given in "Active Crossover Networks for Noncoincident Drivers" by Siegfried H. Linkwitz, *J. Audio Eng. Soc.*, Vol. 24, No. 1, January/-

February, 1976, pp. 2–8. See also "Loudspeaker System Design" by Siegfried Linkwitz, *Wireless World,* May, 1978, pp. 52–56 and "Loudspeaker System Design—part 2" by Siegfried Linkwitz, *Wireless World,* June, 1978, pp. 67–72.

The time delay means 46 is preferably formed by the required number of cascaded second order Bessel all-pass networks. To provide the 1.9 millisecond delay required in the practical embodiment, three such networks are cascaded to provide a sixth-order Bessel all-pass time delay network. Such networks are described in the article "Second-Order All-Pass RC Active Networks" by George Wilson, *IEEE Transactions on Circuits and Systems,* Vol. CAS-24, No. 8, August, 1977, pp. 446+.

In the practical embodiment, the crossover frequency is 500 Hz. The exact crossover frequency is not critical, but was chosen for several practical and theoretical reasons. Most importantly, the crossover frequency was chosen to provide a first order match between woofer and tweeter dispersion at that frequency. By doing so it is possible to avoid the classical tradeoff between the direct radiated sound response and the power response (e.g., the summed response at all angles). As the frequency rises upwards toward 500 Hz, the vertical dispersion of the woofers collapse and match, to a substantial degree, the 40 degree angle of the tweeter horn at crossover. Thus, audible coloration at the crossover frequency is avoided by substantially eliminating any anomolous "bump" in power response at crossover. It will be appreciated that there is an interplay between the choice of loudspeaker components (dispersion characteristics will differ as will operating frequency bands) and a suitable crossover frequency to meet this requirement.

A further reason for the choice of 500 Hz as the crossover frequency is that the frequency is well within the operating frequency band of the preferred woofer and tweeter drivers. Another reason is that 500 Hz historically is widely accepted as a crossover frequency for theater loudspeaker systems.

The crossover networks and time delay network of FIG. 3 are implemented in an active circuit embodiments.

Figure 5:
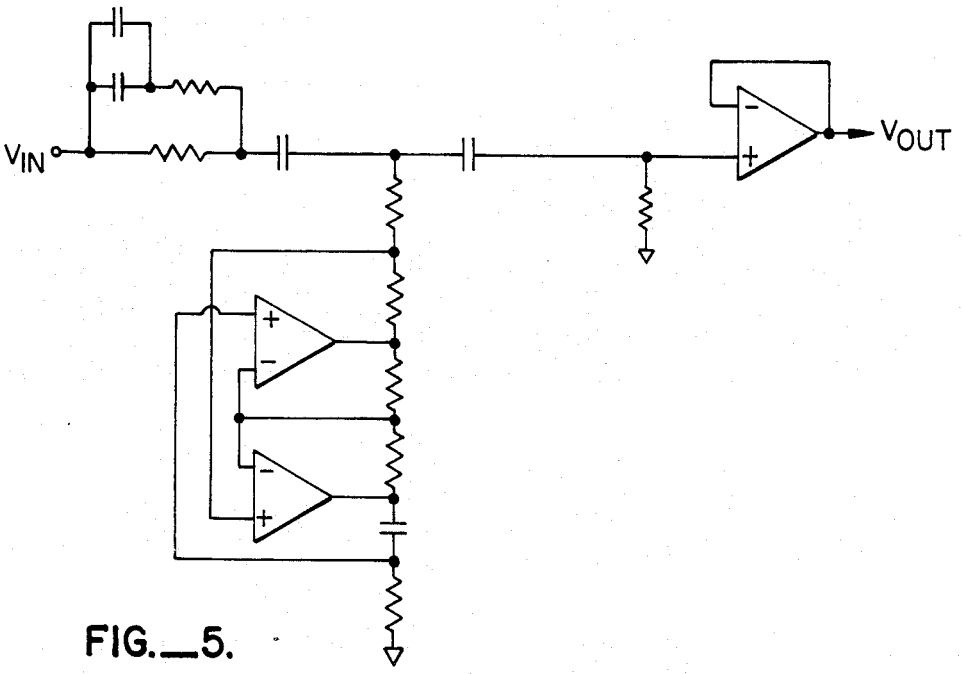
FIG. 5 is a schematic circuit diagram showing an embodiment of the high pass crossover network.
Figure 4:
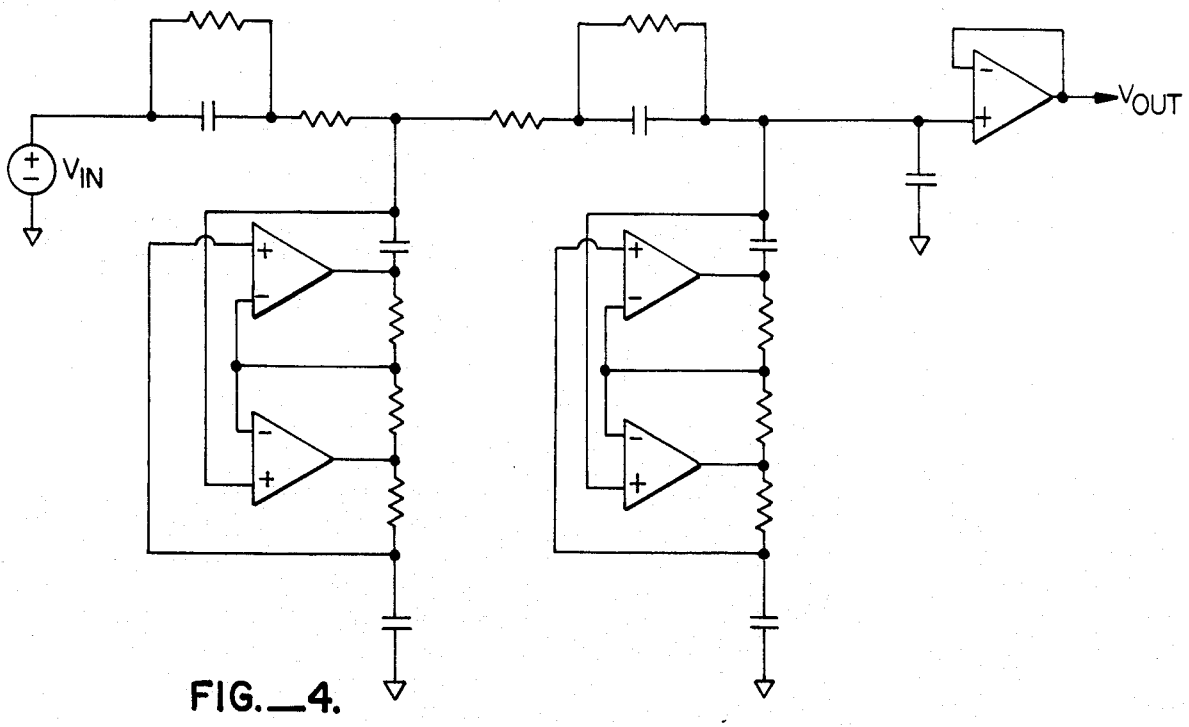
FIG. 4 is a schematic circuit diagram showing an embodiment of the low pass crossover network.
Figure 6:
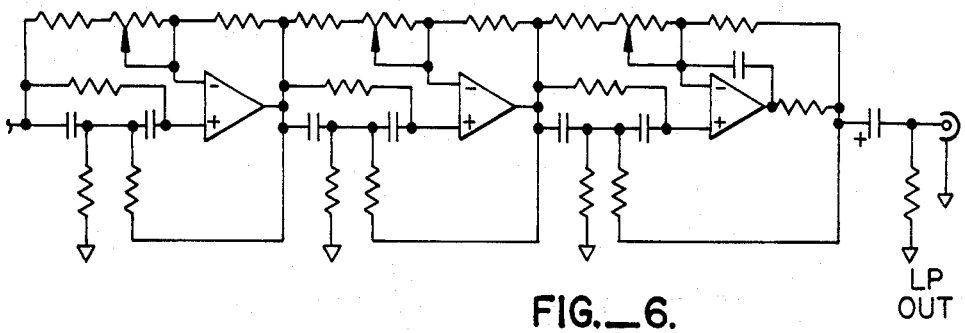
FIG. 6 is a schematic circuit diagram showing an embodiment of the time delay network.

FIGS. 4 and 5 show active circuit implementations of the Linkwitz-Riley low-pass and high-pass networks, respectively. These active circuit networks employ techniques such as those set forth in "Multiple-Amplifier RC-Active Filter Design with Emphasis of GIC Realizations" by L. T. Bruton, paper 3–4 in *Modern Active Filter Design,* edited by Schaumann et al. IEEE Press, New York, 1981 (Reprinted from *IEEE Trans. Circuits Syst.,* Vol. CAS-25, pp. 830–845, October 1978). Transformations of ladder simulation networks are used in developing the active circuits. In the active low-pass network (FIG. 4), frequency dependent negative resistors are simulated by the dual amplifier ladder networks and in the active high-pass network (FIG. 5), a gyrator inductance simulator is employed. FIG. 6 shows the details of the practical embodiment of the three second-order Bessel networks for providing the time delay. Active networks are preferred because they exhibit low sensitivity to component errors.

Figure 7:
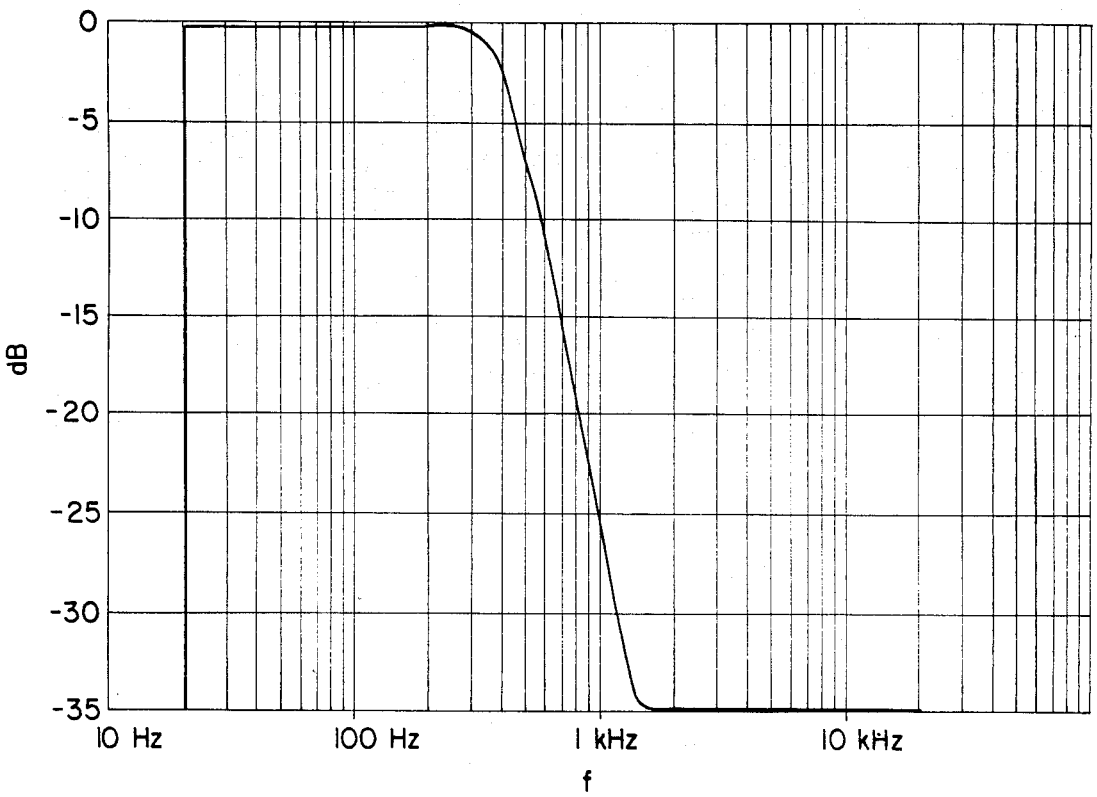
FIG. 7 is a response curve of low pass crossover network such as in the embodiment of FIG. 4.
Figure 8:
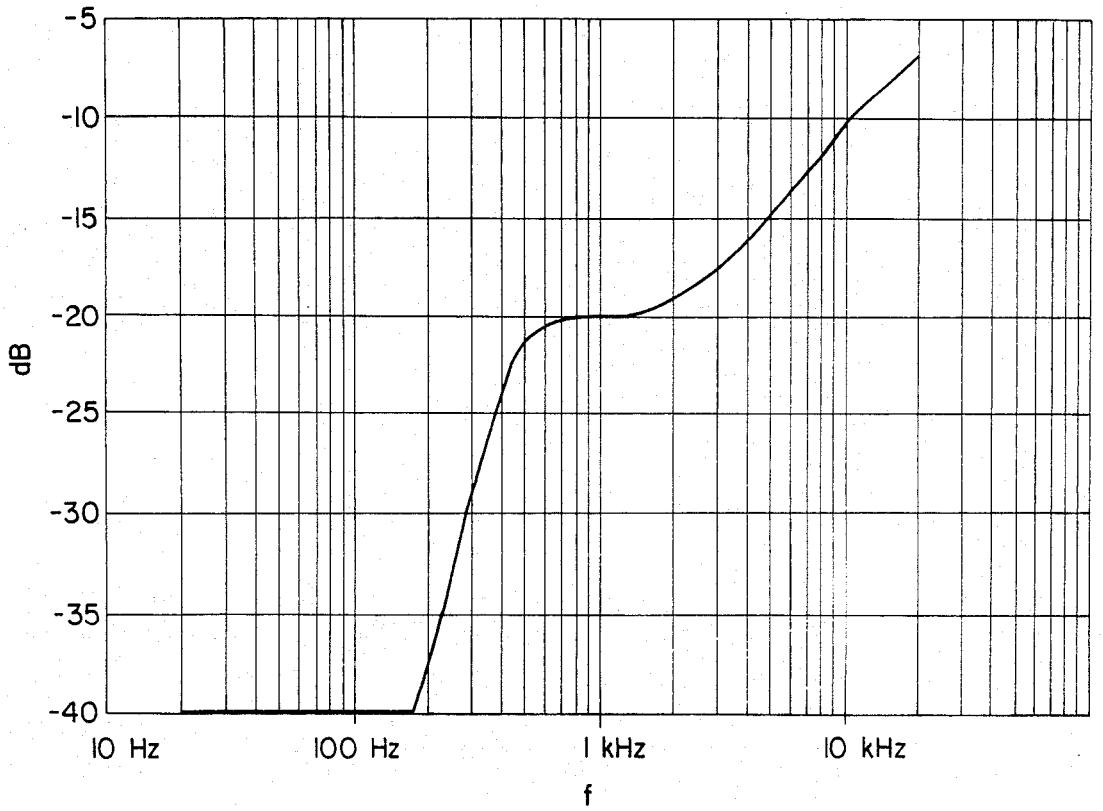
FIG. 8 is a response curve of high pass crossover network such as in the embodiment of FIG. 5 and incorporating additional high frequency equalization.

Amplitude response curves of practical embodiments of the low-pass and high-pass networks of FIGS. 4 and 5 are shown in FIGS. 7 and 8, respectively. In practice, the crossover networks include suitable equalization as may be necessary to compensate for one or more of the following conditions: (1) a falling high frequency response of the high frequency horn compression driver; (2) the high frequency rolloff observed in the theater on the audience side of the motion picture screen due to the screen's high frequency attenuation; and (3) a correction factor added so that the final theater response meets applicable international standards (such as ISO-2969). The high frequency response curve of FIG. 8 includes a high frequency boost starting at about 1500 Hz to compensate for conditions 1 and 2.

I claim:

1. A loudspeaker and motion picture screen system for use in a theater, the system comprising a motion picture screen which is substantially transmissive to low frequency sound energy and which becomes increasingly reflective as the frequency of the sound energy rises in the high frequency region, acoustical boundary means substantially parallel to, spaced from, and at least partially co-extensive with said screen, said acoustical boundary means having the acoustic characteristics of reflecting low frequency and high frequency sound energy, loudspeaker means adjacent said acoustical boundary means, said loudspeaker means including at least low frequency and high frequency loudspeaker elements radiating sound energy towards said screen, the screen facing portion of the low frequency loudspeaker element or elements substantially flush with said acoustical boundary means, and sound absorptive means adjacent said acoustical boundary means in the vicinity of said high frequency loudspeaker element or elements, said absorptive means having acoustic characteristics such that high frequency sound energy is substantially absorbed, whereby the rerediation of reflected high frequency sound energy from said screen is reduced.

2. The loudspeaker and motion picture screen system of claim 1 wherein the sound absorptive means is frequency dependent and has a high frequency absorption characteristic complementary to the high frequency reflection characteristic of the screen, whereby the absorption increases as the reflection increases with frequency.

3. The loudspeaker and motion picture screen system of claim 2 wherein the sound absorptive means is substantially transmissive to low frequency sound produced by said low frequency loudspeaker element or elements, whereby the flush relationship of said surface and the screen facing portion of the low frequency loudspeaker element or elements is acoustically unaffected.

4. The loudspeaker and motion picture screen system of claim 1 wherein the sound absorptive means is frequency dependent and is substantially transmissive to low frequency sound produced by said low frequency loudspeaker element or elements, whereby the flush relationship of said surface and the screen facing portion of the low frequency loudspeaker element or elements is acoustically unaffected.

5. The loudspeaker and motion picture screen system of any of claims 1 through 4, further comprising means including crossover network means for applying audio information carrying electrical energy to said loudspeaker elements, said crossover network means having at least one crossover frequency for dividing the audio information carrying electrical energy into at least low frequency and high frequency paths for application to the respective low frequency and high frequency loudspeaker elements, wherein the crossover frequency for dividing the energy into low frequency and high frequency paths is below the frequency at which the screen begins to reflect substantial high frequency sound energy.

6. The loudspeaker and motion picture screen system of claim 5, wherein the crossover frequency is at a frequency at which there is substantially a first order match of the dispersion characteristics of the low frequency and high frequency loudspeaker elements.

7. The loudspeaker and motion picture screen system of claim 6, wherein the portion of said crossover network means providing said crossover frequency comprises 24 dB/octave low-pass and high-pass filter sections having substantially matched phase responses and magnitude curves that intersect at substantially −6 dB at the crossover frequency, including the amplitude and phase effects of the loudspeaker elements.

8. The loudspeaker and motion picture screen system of claim 7, wherein said crossover frequency is in the order of 500 Hz.

9. The loudspeaker and motion picture screen system of claim 5, wherein the portion of said crossover network means providing said crossover frequency comprises 24 dB/octave low-pass and high-pass filter sections having substantially matched phase responses and magnitude curves that intersect at substantially −6 dB at the crossover frequency, including the amplitude and phase effects of the loudspeaker elements.

10. The loudspeaker and motion picture screen system of claim 9, wherein said crossover frequency is in the order of 500 Hz.

11. The loudspeaker and motion picture screen system of claim 5, wherein said loudspeaker means include at least one combination of low frequency and high frequency loudspeaker elements, the low frequency loudspeaker elements including at least one direct radiator cone transducer mounted in a vented box enclosure and the high frequency loudspeaker elements include at least one constant directivity horn and compression driver.

12. The loudspeaker and motion picture screen system of claim 11, wherein the crossover frequency is at a frequency at which there is substantially a first order match of the dispersion characteristics of the at least one direct cone transducer and the at least one constant directivity horn and compression driver.

13. The loudspeaker and motion picture screen system of claim 11, wherein the low frequency loudspeaker elements include two direct radiator cone transducers mounted in the vented box enclosures and the high frequency loudspeaker include one constant directivity horn and compression driver.

14. The loudspeaker and motion picture screen system of claim 13, wherein said two cone transducers are located vertically adjacent to each other and wherein the high frequency loudspeaker elements are located above and adjacent the low frequency loudspeaker elements.

15. The loudspeaker and motion picture screen system of claim 14, wherein said cone transducers are located closer to the screen than the horn compression driver and wherein said means including crossover network means further includes means for providing a time delay in the low frequency path to restore temporal coherence.

16. The loudspeaker and motion picture screen system of claim 14, wherein there are a plurality of combinations of low frequency and high frequency loudspeaker elements spaced apart and located substantially horizontally behind the screen at a height about midway along the screen's vertical dimension.

17. The loudspeaker and motion picture screen system of claim 11, wherein the high frequency loudspeaker elements are located above and adjacent the low frequency loudspeaker elements.

18. The loudspeaker and motion picture screen system of claim 17, wherein there are a plurality of combinations of low frequency and high frequency loudspeaker elements spaced apart and located substantially horizontally behind the screen at a height about midway along the screen's vertical dimension.

19. The loudspeaker and motion picture screen system of claim 5, wherein said crossover network means includes equalization means.

20. The loudspeaker and motion picture screen system of claim 19, wherein said equalization means is for compensating for at least one of the following conditions: (1) a falling high frequency response of the high frequency horn compression driver; (2) the high frequency rolloff observed in the theater on the audience side of the motion picture screen due to the screen's high frequency attenuation; and (3) a correction factor added so that the final theater response meets applicable international standards.

* * * * *

UNITED STATES PATENT AND TRADEMARK OFFICE

CERTIFICATE OF CORRECTION

PATENT NO. : 4,569,076

DATED : Feb. 4, 1986

INVENTOR(S) : Holman

It is certified that error appears in the above-identified patent and that said Letters Patent is hereby corrected as shown below:

Cover Sheet:

References Cited, Other Publications:

line 3 of 5th listed publ.: insert --"-- after "Transducer,";
line 1 of 6th listed publ.: "J." should be --James--;
line 2 of 14th listed publ.: "of" should be --on--; and
insert --)-- after "(List continued on next page."

Abstract:

Line 11: "netowrk" should be --network--.

Figures:

Fig. 6: delete the far right "+" (near "LP OUT").

Specification:

Col. 2, line 17: "tone" should be --tonal--;
Col. 3, line 21: "frequency" should be --filter--; (1st occurr.)
Col. 3, line 22: "tone" should be --tonal--;
Col. 4, line 68: insert --low frequency-- between "of" and "absorptivity";
Col. 5, line 38: "spacial" should be --spatial--;
Col. 5, line 63: "rotatation" should be --rotation--; and
Col. 7, line 62: insert --ladder-- between "Active" and "networks".

UNITED STATES PATENT AND TRADEMARK OFFICE

CERTIFICATE OF CORRECTION

PATENT NO. : 4,569,076

DATED : Feb. 4, 1986

INVENTOR(S) : Holman

It is certified that error appears in the above-identified patent and that said Letters Patent is hereby corrected as shown below:

Col. 8, line 37: "rerediation" should be --re-radiation--;

Col. 8, line 43: insert --substantially-- between "characteristic" and "complementary"; and Col. 9, lines 6-8: replace "the frequency at which the screen begins to reflect substantial high frequency sound energy" with --five kilohertz--.

Signed and Sealed this

*First* Day of *July 1986*

[SEAL]

*Attest:*

DONALD J. QUIGG

*Attesting Officer* *Commissioner of Patents and Trademarks*